United States Patent [19]

Okura

[11] 4,301,724

[45] Nov. 24, 1981

[54] PLANE PRINTING MACHINE

[75] Inventor: Tsunehiko Okura, Konan, Japan

[73] Assignee: Ishizuka Glass Co., Ltd., Nagoya, Japan

[21] Appl. No.: 102,132

[22] Filed: Dec. 10, 1979

[51] Int. Cl.[3] ..... B41F 17/24

[52] U.S. Cl. ..... 101/35; 101/126

[58] Field of Search ..... 101/35, 38 R, 38 A, 101/39, 40, 123, 126

[56] References Cited

U.S. PATENT DOCUMENTS

| | | | |
|---|---|---|---|
| 1,904,332 | 4/1933 | Sidebotham | 101/38 A |
| 2,015,086 | 9/1935 | Paynter et al. | 101/38 R |
| 2,461,281 | 2/1949 | Jackson et al. | 101/123 |
| 2,881,699 | 4/1959 | Hakogi | 101/126 |
| 3,110,247 | 11/1963 | Simpson | 101/38 R |

FOREIGN PATENT DOCUMENTS

| | | | |
|---|---|---|---|
| 54-72208 | 9/1979 | Japan . | |
| 1215704 | 12/1970 | United Kingdom | 101/38 R |

*Primary Examiner*—Clifford D. Crowder

*Attorney, Agent, or Firm*—Quaintance, Murphy & Richardson

[57] ABSTRACT

A plane printing machine comprising a table rotatable intermittently in one direction, a plurality of printed-object holders provided self-rotatably around said table, planet gears aligned coaxially with respective printed-object holders, and a sun gear rotatable alternately in normal and reverse directions meshing with each planet gear, characterized in that it is equipped with a means to prevent the rotation of said sun gear in reverse direction from being transmitted to the printed-object holders and a means to executed plane printing on an object being held at rest by the action of the former means.

10 Claims, 4 Drawing Figures

PLANE PRINTING MACHINE

BACKGROUND OF THE INVENTION

1. Field of the Invention

The present invention relates to a plane printing machine to print on the surface of an object, more specifically to a printing machine applicable for plane printing on the surface of a prismatic body like a square bottle.

2. Description of the Prior Art

A device for printing on the side surface of a prismatic body like a square bottle has been available for a long time and there are a wide variety of them. The typical machine employed in the bottle-making industry for printing on square bottles is of such a system that many spindles are fitted to a pair of parallel-moving endless chains; a square bottle is chucked to each spindle; at the printing station the spindle is pushed up to bring the bottle close to the plane printing screen; and the printing is done on the surface of the bottle by the screen pressed against it by a squeegee. The printing machine of this system has the merits that a large number of printing stations can be easily set up and multicolor printing is easy to execute; but the demerits that it takes long time to exchange the parts with another ones for other type of bottles; routine maintenance of the machine is troublesome; the accuracy of printing is low; and, being a chain conveyor system, the machine is unfit for high-speed operation. Therefore such a printing machine is not necessarily satisfactory.

There is also a semi-automatic printing machine in which the feed and delivery of bottles are done manually, but, as a matter of course, this one is not available for high-speed operation either.

Thus no printing machine has existed which can execute fast, exact printing on the surface of such an object as square bottle with use of a few spindles.

SUMMARY OF THE INVENTION

The main object of the present machine is to provide a plane printing machine free from the above-mentioned drawbacks of the conventional machine, which contains a fewer spindle heads with easiness of replacing the parts with another ones for other type of bottles and routine maintenance of the machine.

Another object of the present invention is to provide a plane printing machine characterized by high-precision positioning which is made possible by holding a printed object to the end of operation without releasing it once it is chucked and doing all the transfer motions of it through gearing mechanism.

Still another object of the present invention is to provide a plane printing machine which can successively execute plane printing on the surfaces of many prismatic bodies by transferring them rotatingly with a specific pitch from one printing station to another by means of a planet gearing.

Still another object of the present invention is to provide a plane printing machine which can execute plane printing on the surface of an object while it is being held at rest by a means to prevent the reverse rotation of the sun gear from being transmitted to the printed object holder.

Still another object of the present invention is to provide a plane printing machine which can print faster than the conventional machine of chain conveyor type.

The other objects of the present invention will become apparent from the following detailed account.

DETAILED DESCRIPTION OF THE PREFERRED EMBODIMENT

The essential feature of the present invention lies in the construction of a plane printing machine characterized in that it comprises a table rotatable intermittently in one direction, a plurality of holders for printed objects or objects to be printed (hereinafter referred to as printed-object holders) self-rotatably installed around said table, planet gears aligned coaxially with respective printed object holders, a sun gear rotatable alternately in normal and reverse directions meshing with each planet gear, a means to prevent the reverse rotation of the sun gear from being transmitted to teh printed object holders and a means to execute plane printing on the surface of a printed object being held at rest by the action of the former means. The present invention is here to be described in detail referring to a preferred embodiment of it.

Figure 1:
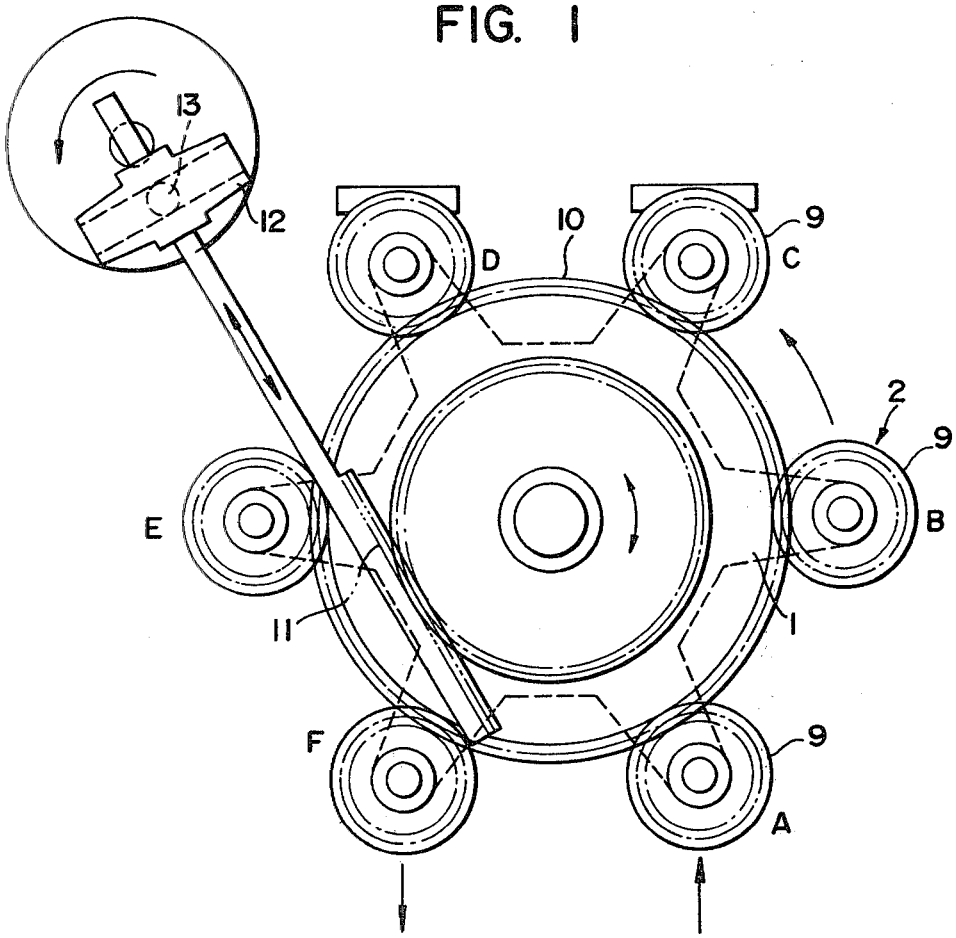
FIG. 1 is a side view illustrating the working principle of a plane printing machine according to the present invention.
Figure 2:
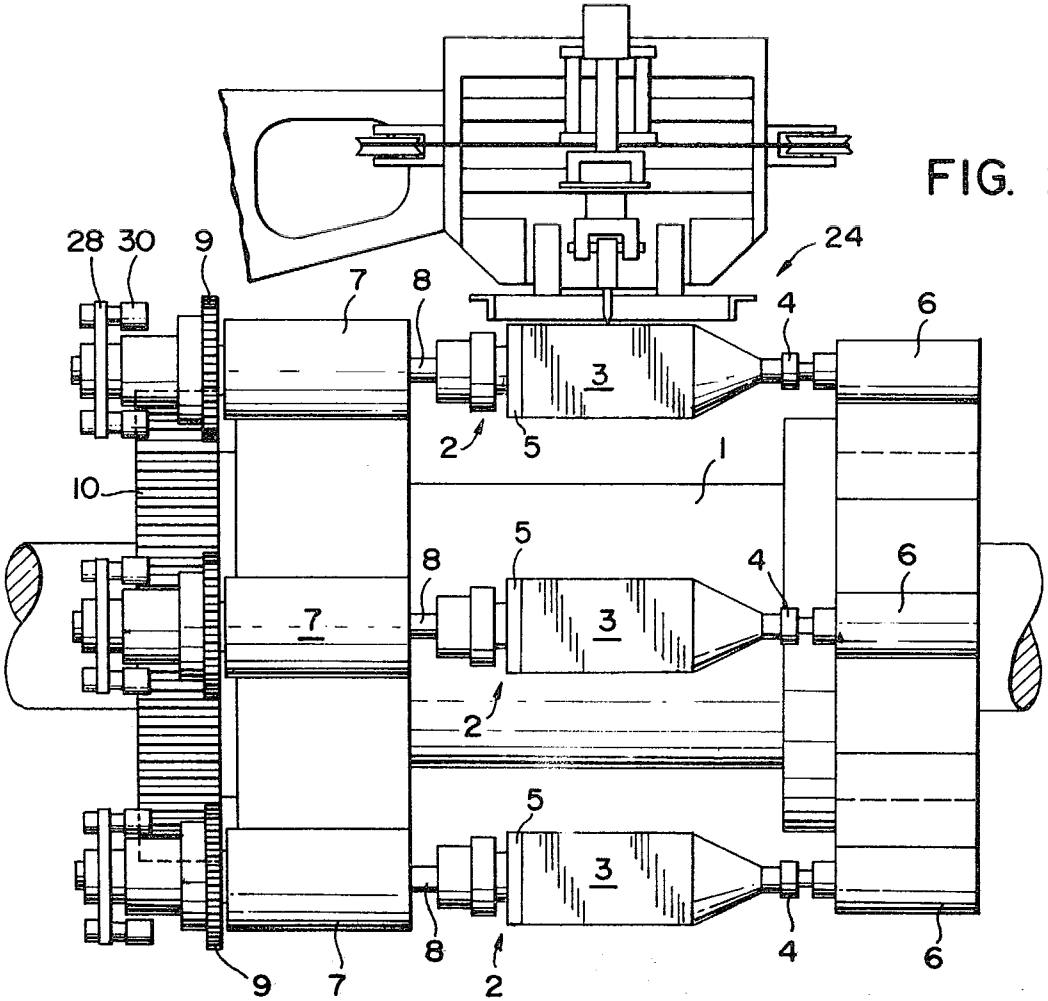
FIG. 2 is a front elevation view of a plane printing machine according to the present invention.

FIGS. 1 and 2 schematically show one embodiment of the present invention.

In the device according to the present invention there are a table 1 intermittently rotatable with a pitch of 60° around a horizontal shaft and six sets of printed-object holders 2 installed equi-spaced around said table. Said holder 2 consists, as indicated in FIG. 2, of a mouth-holder 4 to chuck the mouth of a printed object 3 (a square bottle in this example) and a bottom-holder 5 to chuck the bottom of said object. The mouth-holder 4 is only rotatably supported on a bearing 6, while the bottom-holder 5 is, as described fully later, is supported on a bearing 7 both rotatably and longitudinally slidably, to permit the printed object 3 to be mounted or dismounted. The spindle 8 of the bottom-holder 5 is at its rear end coupled with a planet gear 9 which is all the time meshing with a sun gear 10.

The sun gear 10, as shown in FIG. 1, is made alternately rotatable in normal and reverse directions by a reciprocating rack 11. For expediency of explanation, the rotating direction of the table 1, i.e., counterclockwise direction in FIG. 1 is taken as normal. The rotating angle of the sun gear 10 can be freely set by adjusting the eccentricity of the cam roller 13 meshing with the yoke which drives the rack 11. At the position A in FIG. 1, the object 3 to be printed is chucked to the holder 2; at C, D the printing is done; and at F the printed object is released.

Suppose there are 225 teeth in sun gear 10 and 45 teeth in planet gear 9 and the sun gear 10 is rotated in ordinary and reverse directions each by 108°. Then, when the table 1 is rotated by 60° and at the same time the sun gear 10 is rotated in normal direction, the number of rotations for the planet gears 9 will be given as $\frac{1}{2}$ from the following formula;

$$\text{Number of rotations for planet gear} = \left(1 + \frac{\text{Number of teeth in sun gear}}{\text{Number of teeth in planet gear}}\right) \times (\text{number of rotations for table}) - \left(\frac{\text{Number of teeth in sun gear}}{\text{Number of teeth in planet gear}}\right) \times (\text{number of rotations for sun gear}) =$$

$$\left(1 + \frac{225}{45}\right) \times \frac{1}{6} - \frac{225}{45} \times \frac{108}{360} = -\frac{1}{2}$$

This implies that while the planet gear moves on to the next position by the rotation of the table 1, said plane gear rotates 180° clockwise. In other words, while the object 3 to be printed, say, a square bottle, chucked to the holder 2 coaxially with the planet gear moves from C to D, 180° reversed rotation takes place, which is convenient for printing on both side surfaces, opposed to each other, of the square bottle. However, under this arrangement alone it would happen that while the sun gear 10 rotates in reverse direction (thereby the table 1 is supposed to be at rest), the plane gear 9 rotates 540° (1.5 rotations) counterclockwise, which is inconvenient for plane printing on the surface of the square bottle. It is for this reason that a means to prevent the reverse rotation of the sun gear 10 from being transmitted to the printed object holders is additionally provided according to the present invention, as described in FIG. 3.

Figure 3:
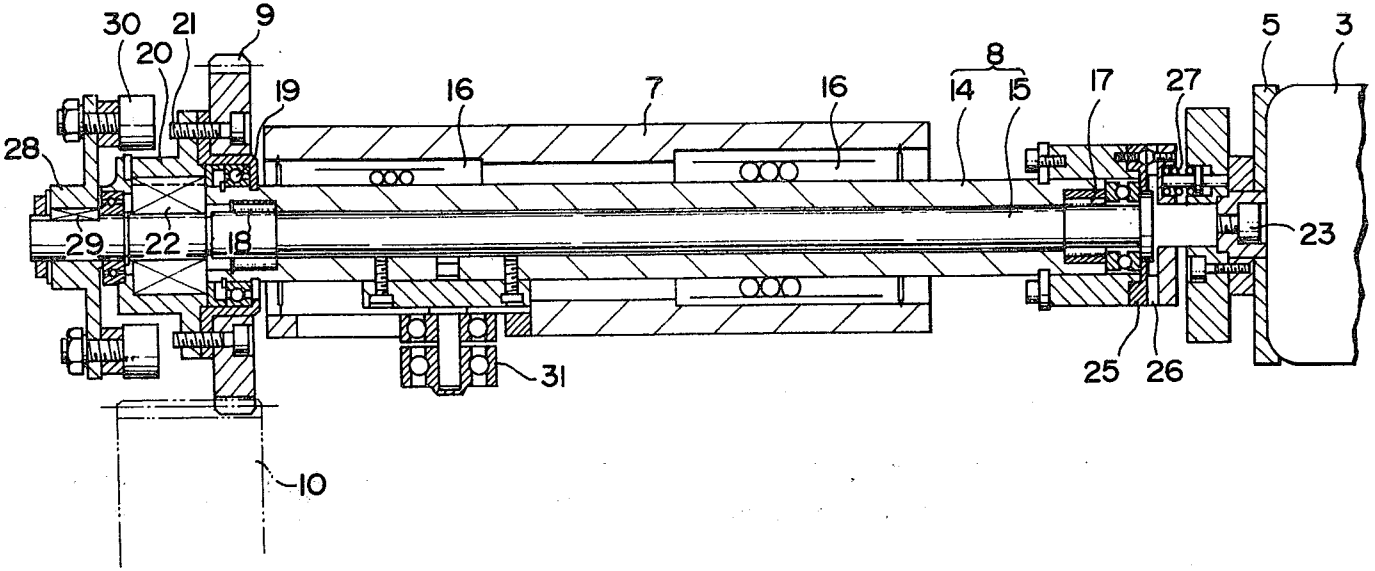
FIG. 3 is a sectional view showing the principal parts of a plane printing machine according to the present invention.

FIG. 3 is a sectional view illustrating the relationship among the bottom-holder 5, the spindle 8, and the planet gear 9. The spindle 8 consists of an external spindle sleeve 14 and an internal spindle shaft 15. The spindle sleeve 14 is supported slidably in the longitudinal direction by a linear-motion bearing 16, but it cannot rotate. The spindle shaft 15 is supported by the needle bearings 17, 18 rotatably within the spindle sleeve 14. Around the left end of the spindle sleeve 14 is installed a planet gear 9 through the ball bearing 19, said planet gear 9 being secured through bolts 21 to the clutch housing 20.

A ratchet mechanism 22 is provided between the clutch housing 20 and the spindle shaft 15. The ratchet mechanism 22 works such that it permits rotation of the spindle shaft 15 only when the planet gear 9 rotates clockwise in FIG. 1, but it does not transmit rotation to the spindle shaft 15 when said gear 9 rotates counterclockwise (FIG. 1 corresponds to be left side view in FIG. 3).

Since the bottom-holder 5 is secured to the right end of the spindle shaft 15 by means of a bolt 23, the bottom-holder 5 and the square bottle 3 chucked thereto will rotate, if the spindle shaft 15 is driven by the plane gear 9 via the ratchet mechanism 22. When, however, the planet gear 9 rotates counterclockwise in FIG. 1, the action of the ratchet mechanism 22 keeps the spindle shaft 15 at rest and accordingly the square bottle 3 also at rest.

Putting together the above description and the description about the mechanism of planet gears referring to FIG. 1, it is apparent that whereas the normal (counterclockwise) rotation of the sun gear 10 causes a clockwise rotation of the planet gear 9 and in consequence a reversed motion of the square bottle 3, the reverse rotation of the sun gear 10 does not cause a rotation of the square bottle 3.

Thus with the square bottle 3 held at rest when the sun gear 10 makes a reverse rotation, plane printing on the side surface of the bottle can be executed by an appropriate means 24 for screen printing.

With the above-mentioned motion of the table 1 the object 3 to be printed as transferred from A to B and then from B to C with a specified pitch of, say, 180°. Thereby through the planet gear 9 may make an exact rotation of 180°, the spindle shaft 15 is likely to continue rotation on account of inertia even after the halt of the planet gear 9, because the ratchet mechanism 22 is interposed between the spindle shaft 15 and the plane gear 9. To prevent this inertial motion, a flange 25 is fitted at the right end of the spindle sleeve 15 and against said flange a brake shoe 26 is pressed by a spring 27. Since the brake shoe 26 is supposed to be integrated with the bottom-holder 5, a free rotation of the bottom-holder 5 or the spindle shaft 15 is frictionally prohibited.

The spindle shaft 15 is thus restrained not to make a free rotation by the frictional force of the brake shoe 26, but in the process of printing a load of 10–20 Kg falls on the object to be printed and this load is likely to cause rotation of the printed object 3, the bottom-holder 5 and the spindle shaft 15.

Figure 4:
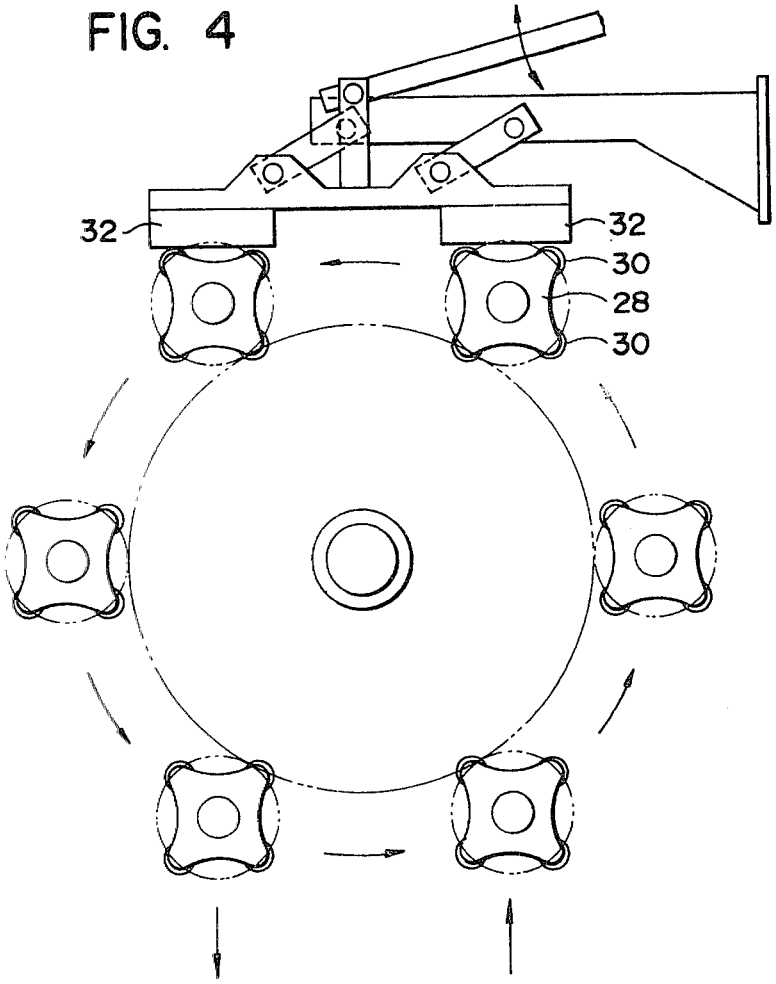
FIG. 4 is a side view showing the action of a pressure board in a plane printing machine according to the present invention.

In prevention of their rotation a roller wheel 28 is secured to the left extreme of the spindle shaft 15 by means of a key 29. The roller wheel 28 is equipped with four rollers 30, which are pushed down by a pressure board 32 set at the printing station movably in vertical direction as indicated in FIG. 4, thereby locking the spindle shaft 15 to prevent the rotation of a printed object under printing.

The device also performs a function of correcting an error in the rotating angle of the planet gear 9.

As stated above, the bottom-holder 5 recedes leftward when an object 3 to be printed is fed to the holder 2 or a printed object is delivered thereform. This action takes place when the cam follower 31 attached below the spindle sleeve 14 moves along a slot cam not shown.

The above description concerns a case of printing on two opposed sides of a square bottle. In the case of printing on four sides of it, the rotating angle of the sun gear 10 is set at 90°; then the planet gear 9 being able to rotate by 90° with a shift of the table 1, printing on four sides can be done by utilizing the positions B, C, D, E in FIG. 1. It goes without saying that similar printing is possible on an object of arbitrary profile other than a square bottle.

The printing machine according to the present invention, completely free from the demerits of the conventional plane printing machine, will contribute a great deal to the industries.

What is claimed is:

1. A plane printing machine comprising;

a table rotatable intermittently in one direction;

a plurality of printed object holders each rotatable on its own axis, installed around said table at equal distances from the center of rotation of said table;

planet gears installed coaxially with respective printed object holders;

a sun gear having its center of rotation aligned with the center of rotation of said table, and rotatable alternately in normal and reverse directions, said sun gear all the time meshing with each planet gear;

a means to prevent the reverse rotation of said sun gear from being transmitted to said printed object holder;

and a means to execute plane printing on an object to be printed being held at rest by the action of the reverse rotation preventing means.

2. The plane printing machine of claim 1, wherein the intermittent rotating angle of the table is 60° and there are 6 printed object holders installed around the table.

3. The plane printing machine of claim 1, wherein the printed object holder consists of a mouth-holder to chuck the mouth of an object to be printed and a bottom-holder to chuck the bottom of the object to be printed; and the bottom-holder is supported rotatably and longitudinally slidably.

4. The plane printing machine of claim 1, wherein the rotating angle of the sun gear is adjustable.

5. The plane printing machine of claim 4, wherein the means to adjust the rotating angle of the sun gear comprises a reciprocating rack meshing with the sun gear; a yoke fitting to said rack; and an eccentrically rotating cam roller engaged with the yoke.

6. The plane printing machine of claim 1, wherein said reverse rotation-preventing means is a ratchet mechanism.

7. The plane printing machine of claim 1, further comprising a flange on each printed object holder which rotates together with the printed object holder, and a brake shoe spring-urged to said flange whereby the printed object holder is prevented from free rotation under inertia.

8. The plane printing machine of claim 1, further comprising a roller wheel on each printed object holder rotatable together with said holder and having a number of rollers; and a pressure board installed at the printing station and movable toward and away from said roller wheel, whereby the rotation of said holder under pressure printing can be stopped by pushing the pressure board against said rollers.

9. The plane printing machine of claim 1, wherein the number of teeth in the sun gear and the number of teeth in the planet gear are so set that a printed object is rotated around its printed object holder at an angle of 180° once the sun gear rotates in normal direction.

10. The plane printing machine of claim 1, wherein the number of teeth in the sun gear and the number of teeth in the planet gear are so set that a printed object is rotated around its printed object holder at an angle of 90° once the sun gear rotates in normal direction.

* * * * *